United States Patent [19]

Davis

[11] Patent Number: 4,999,968

[45] Date of Patent: Mar. 19, 1991

[54] PACKAGING MACHINE POUCH PERFORATOR

[75] Inventor: Steven D. Davis, Yuciapa, Calif.

[73] Assignee: W. A. Lane, Inc., San Bernardino, Calif.

[21] Appl. No.: 459,517

[22] Filed: Jan. 2, 1990

[51] Int. Cl.[5] ..... B65B 61/08; B65B 61/18; B65B 9/02; B65B 41/16

[52] U.S. Cl. ..... 53/133.1; 53/552; 53/554; 83/346; 83/671; 493/238; 493/365

[58] Field of Search ..... 53/133, 551, 552, 554, 53/412, 451, 389; 493/237, 238, 365; 83/339, 36, 671, 917

[56] References Cited

U.S. PATENT DOCUMENTS

| | | | |
|---|---|---|---|
| 2,117,220 | 5/1938 | Sieg | 83/671 X |
| 2,248,471 | 7/1941 | Stroop | 53/412 |
| 2,382,175 | 8/1945 | Salfisberg | 53/554 |
| 2,640,540 | 6/1953 | Stange | 493/238 X |
| 2,903,829 | 9/1959 | Wolff | 53/554 X |
| 3,378,988 | 4/1968 | McClosky | 53/412 X |
| 3,575,091 | 4/1971 | LaBantschinig | 493/365 |
| 4,147,583 | 4/1979 | Deutschlander | 53/133 X |
| 4,254,601 | 3/1981 | Prager et al. | 53/552 X |
| 4,768,411 | 9/1988 | Su | 53/133 X |
| 4,785,696 | 11/1988 | Martiny | 83/346 X |

*Primary Examiner*—Horace M. Culver
*Attorney, Agent, or Firm*—Herb Boswell

[57] ABSTRACT

A pouch perforator for a form, fill and seal packaging machine of the type which forms pouches from continuous film includes a cutting element and a support element. The cutting element is rotatively mounted on the packaging machine as is the support elment with the cutting element located on one side of the film and the support element located on the opposite side of the film. The cutting element includes a plurality of axially extending knife edges located in a circumferentially spaced array. The knife edges rotate in response to rotation of the cutting element. The support element includes a circumferentially extending support surface which rotates in response to rotation of the surface element. The knife edges in response to rotation of the cutting element compress film against the support surface to perforate the film.

13 Claims, 2 Drawing Sheets

PACKAGING MACHINE POUCH PERFORATOR

BACKGROUND OF INVENTION

This invention is directed to a pouch perforator for a form, fill and seal packaging machine. The pouch perforator of the invention is associated With the film advancement pull wheels of the packaging machine for perforation of the edges of pouches formed on the packaging machine in conjunction with operation of the pull wheels.

A variety of products are packaged in film pouches which are formed, filled and sealed on appropriate pouch packaging machines. These machine utilize continuous rolls of film. A pouch is formed from the film, filled with product and then sealed in a continuous operation.

Earlier utilization of film pouches was restricted to dry products. With increased sophistication of pouch packaging machines, packaging has been extended to include liquid and liquid based products. Currently vast numbers of individual packages of condiments such as catsup, mustard and sauces are used on a daily basis in the fast food industry.

With advancement in film technology very strong films have been developed. One such strong film is nylon film. Because of the availability of strong films it has recently become practical to form larger pouches on pouch packaging machines. Using such strong films pouches containing products such as cooking oil can be packaged in pouches of sufficient volume for use in restaurants and other institutional settings. As can be appreciated, large pouches (of about six inches or larger in width and capable of containing a quart or more of, for instance, cooking oil) must be formed of film which is of sufficient strength to insure that the contents of the pouch will not accidentally burst the film.

The use of high strength films to maintain the integrity of the pouches, however, makes it difficult to open such pouches. The very strong nylon films utilized for large, strong pouches are all but impossible to initially tear. This requires the user to utilize a cutting implement, as for instance, a pair of scissors or a knife to open the pouch. The use of such implements are inconvenient for the users of these large pouches.

To overcome the necessity of having to use an implement to open a pouch the edge of a pouch can be perforated with small nicks. This allows the user a starting point to tear the pouch material.

Presently utilized devices for forming perforations or nicks in the edges of pouches are normally located below the cross seal bar of the packaging machine. They require a separate station on the packaging machine having separate components and separate activation and control mechanisms. This complicates both manufacture of these machines and their day to day operation and maintenance.

In addition to the problems outlined in the previous paragraph which are experienced even with small pouches, with larger pouches additional problem are created. During filling of a larger pouch, the pouch can bulge or sag outwardly under the weight of the contents added to the pouch. Since the components of the packaging machine must be spaced away from the pathway of the pouch a distance sufficient to allow for the physical presence of such a bulging pouch, little room remains on "large pouch" packaging machines below the cross seal seal bars. This complicates or renders impossible the placement of perforation or nicking devices in the normal area below the cross seal bars.

BRIEF DESCRIPTION OF THE INVENTION

As is evident from the above there exists a need for new and improved devices for forming perforations in the edge of pouches being formed on a form, fill and seal pouch packaging machine. It is further evident that there exists a need for pouch edge perforating devices which can be located on the pouch packaging machine upstream from any filling operation such that these devices can operate on flat pouch films prior to the distortion of the pouch which occurs when the pouch is filled with product.

The present invention addresses the above objects as well as further objects as will become evident from the remainder of this specification.

A pouch perforator of the invention for a form, fill and seal pouch packaging machine of the type which forms pouches from continuous film includes a cutting element and a support element. Both the cutting element and support elements are rotatively mounted on the pouch packaging machine. These two elements are mounted on the machine in association with one another. The cutting element is located on one side of the film on the machine and the support element is located on the opposite side of the film. The cutting element includes a plurality of axially extending knife edges located in a circumferentially spaced array on the cutting element. The knife edges rotate in response to rotation of the cutting element. The support element includes a circumferentially extending support surface which rotates in response to rotation of the support element. The knife edges on the cutting element in response to rotation of the cutting element compress the film against the support surface to perforate the film.

In a preferred embodiment of the invention the cutting element is cylindrical in shape having a cylindrical surface with the knife edges of the cutting element located on the cylindrical surface and extending radially outwardly from the cylindrical surface. The support surface on the support element is also cylindrical in shape.

In an embodiment of the invention at least the support surface of the support element is formed of an essentially soft metal and at least the knife edges on the cutting element are formed of an unyielding hard metal. In an embodiment of the invention the radius of the cutting element measured from the center point of the cutting element to the apex of one of its knife edges is of a radius greater than the radius of the support element measured from the center point of the support element to the support surface of the support element.

The invention includes a pouch perforator for a form, fill and seal pouch packaging machine of the type which forms pouches from continuous film. The pouch perforator includes a rotatable front pull wheel shaft located on the front side of a film pathway on the packaging machine and a rotatable back pull wheel shaft located on the back side of the film pathway on the packaging machine. The back pull wheel shaft is located on the packaging machine in association with the front pull wheel shaft. A front pull wheel means is located on the front pull wheel shaft. A back pull wheel means is located on the back pull wheel shaft. The front pull wheel means together with the back pull wheel means engages and advances the continuous film on the packaging machine in response to rotations of the front and back pull wheel shafts. A perforation means for perforating at least one edge of pouches formed on the packaging machine is located on at least one of the front or the back pull wheel shafts in operative association with the front or back pull wheel means and is rotated by the pull wheel shaft on which it is located.

The perforation means preferably includes a cutting means for perforating the film and a support means for retaining the film against movement away from the cutting means. The cutting means is located on one of the front or the back shafts and the support means is located on the other of the front or back pull wheel shafts. The cutting means includes a cutting element having at least one knife edge located thereon. The knife edge is for engaging, compressing and perforating the film against the support means.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the packaging art will realize that these principles and/or concepts are capable of being utilized in a variety of embodiments which may differ from the exact embodiments utilized for illustrative purposes herein. For these reasons this invention is not to be construed as being limited to only the illustrative embodiments, but is only to be construed in view of the claims appended hereto.

DETAILED DESCRIPTION OF THE INVENTION

Figure 1:
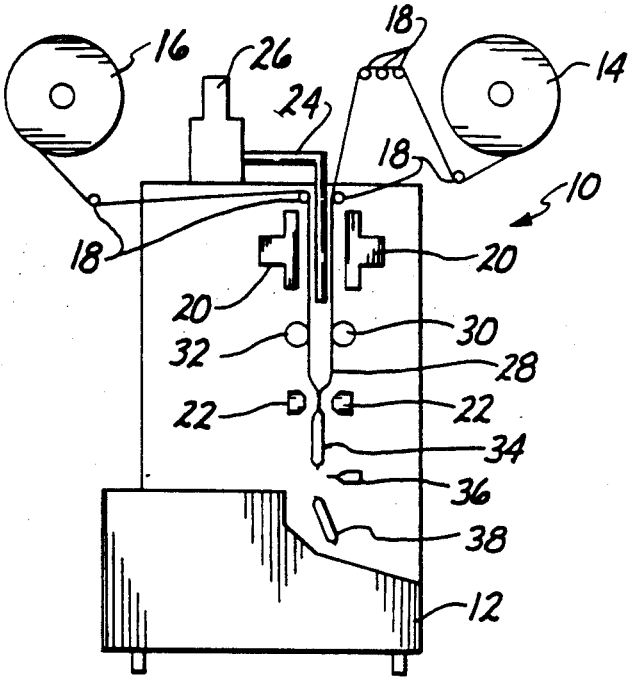
FIG. 1 is a side elevational view of a representational form, fill and seal pouch packaging machine.

Shown in FIG. 1 are the basic components of a form, fill and seal pouch packaging machine. The form, fill and seal pouch packaging machine 10 includes a housing 12. Appropriately suspended on the housing 12 is a front roll of film 14 and a rear roll of film 16. Film from the front and rear rolls of film is fed across feed rollers collectively identified by the numeral 18 to a position between front and back side seals collectively identified by the numeral 20. Positioned below and downstream of the side seals 20 are front and back cross seals collectively identified by the numeral 22.

A feed tube 24 from product reservoir 26 is used to load product in pouches formed on the machine 10. As is seen in FIG. 1 the end of the feed tube 24 is positioned within a partially formed pouch generally identified by the numeral 28.

Front pull wheels 30 and rear pull wheels 32 are used to advance film from the rolls 14 and 16 through the various components of the machine 10. Normally the pull wheels 30 and 32 would continuously rotate and would be indexed toward and away from each other. When the pull wheels 30 and 32 are indexed toward one another they contact and grip the film between them. The wheels 30 and 32 rotate in opposite directions with wheel 32 rotating in a clockwise direction and wheel 30 rotating in a counter clockwise direction such that film from the rolls 14 and 16 is pulled across the feed rollers 18 between the side seals 20.

Side seams are formed in the descending film by the side seals 20. The machine is then indexed engaging the pull wheels 30 and 32 against the film. This pulls the film having side seals formed therein downstream from the side seals 20 to the area adjacent to the cross seals 22. The cross seals 22 are activated to form a cross seal in the film. This forms the bottom seam of an upper most partially formed pouch, pouch 28, and the top seam in a lower pouch, a product containing pouch 34. A cutoff knife 36 positioned below the cross seals 22 is then utilized to sever a finished pouch 38 from the filled pouch 34.

Concurrently product from the reservoir 26 is added via the feed tube 24 to the partially formed pouch 28. On the next index of the machine the partially formed pouch 28 descends below the cross seals 22. On the next activation of the cross seals 22 it concurrently forms the top seam in that pouch as well as the bottom seam in the next upstream pouch on the machine 10.

When the front and back pull wheels 30 and 32 engage the film to pull it from the rolls 14 and 16 they grip the film in the area of the film where side seams are now located. When the film is so engaged by the pull rollers 30 and 32 it is advanced on the machine 10 until such time as the continuously rotating pull wheels 30 and 32 are pulled away from the film. At that time the film is no longer advanced and the side seam, cross seal, filling and knife cut off operations can be effected.

Figure 4:
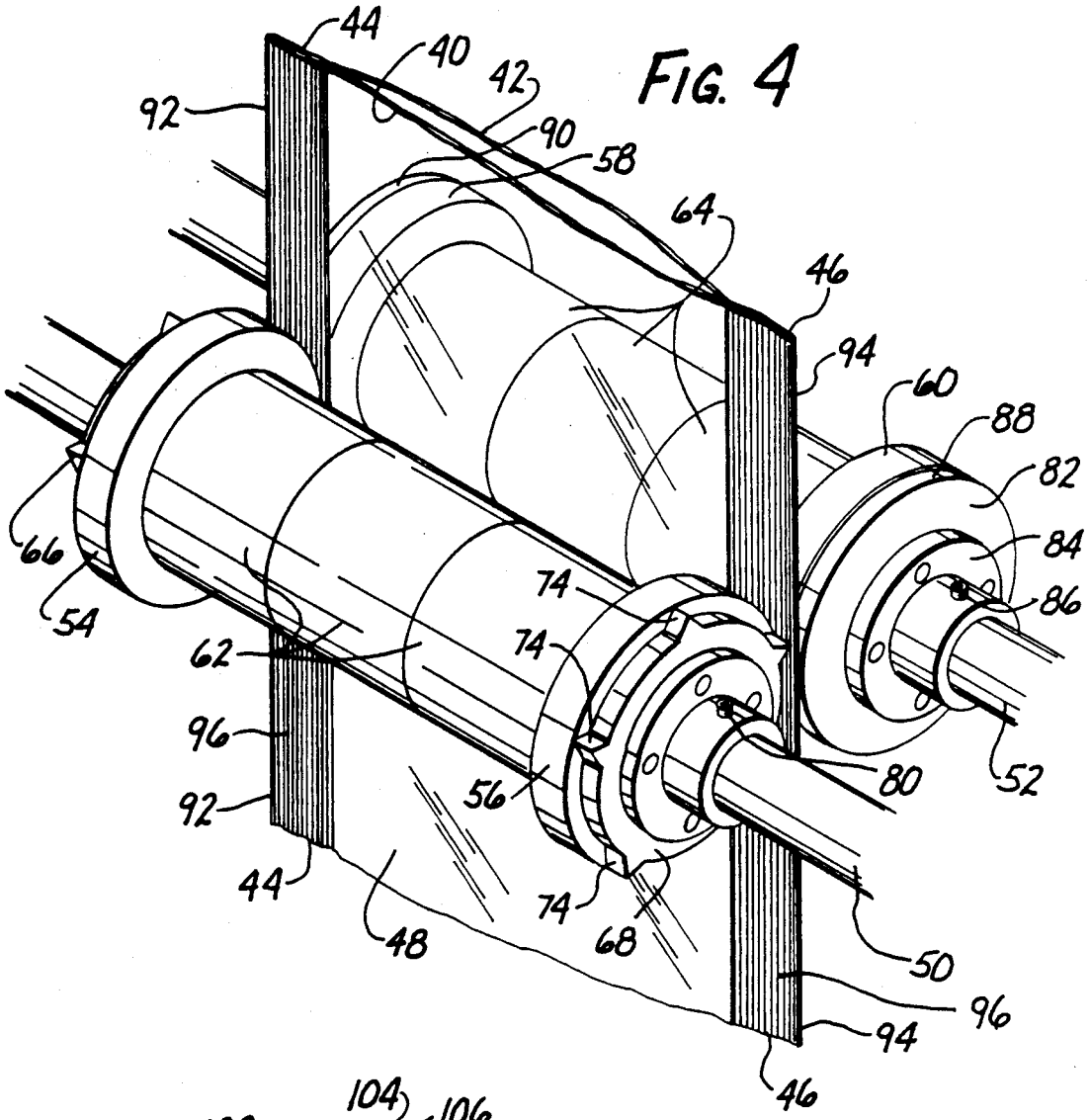
FIG. 4 is an oblique view of a pouch perforator of the invention showing this pouch perforator located in association with front and back pull wheel shafts, pull wheels located on said front and back pull wheel shafts and a film pouch being advanced between these pull wheels.

FIG. 4 is a fragmentary view of that portion of the machine 10 wherein the front and back pull wheels are located. In FIG. 4 a front film 40 and a back film 42 have been joined together along left side seam 44 and right side seam 46 by appropriate side seals, as for instance, the side seals 20 of FIG. 1. This forms a partially formed pouch 48 which in essence is simply an elongated tube formed from the front and back films joined along their side edges.

The tube 48 is positioned between a front pull wheel shaft 50 and a rear pull wheel shaft 52. Located on the shaft 50 is left front pull wheel 54 and right front pull wheel 56. Located on the back pull wheel shaft 52 is a left rear pull wheel 58 and a right rear pull wheel 60.

The shaft 50 rotates in a clockwise direction and the shaft 52 rotates in a counter clockwise direction. Mechanisms (not separately numbered or shown) which support and rotate the shafts 50 and 52 move them toward one another and away from one another in response to indexing of the machine 10.

When the shafts 50 and 52 are moved toward one another, the right pull wheels 56 and 60 grip the films 40 and 42 along the seam 46 and the left pull wheels 54 and 58 grip the films 40 and 42 along the left seam 44 to advance the films 40 and 42 downwardly between the pull wheels. After an appropriate length of film 40 and 42 has been advanced by the respective pull wheels 54, 58, 56 and 60, the pull wheel shafts 50 and 52 are retracted away from one another withdrawing the respective pull wheels 54, 58, 56 and 60 from the films 40 and 42. When the pull wheels 54, 58, 56 and 60 are retracted from the seams 44 and 46, movement of the films 40 and 42 stops. The films 40 and 42 remain stationary such that the appropriate operations of the machine 10, i.e. the formation of side seams with the side seals 20, cross seams with the cross seals 22, etc., can be effected.

The front pull wheels 54 and 56 are separated from one another along the length of the shaft 50 by a plurality of bushings collectively identified by the numeral 62. These space the pull wheels 54 and 56 away from one another an appropriate distance corresponding to the width of the pouch 48 being formed on the machine. In a like manner bushings 64 are utilized to space the pull wheels 58 and 60 along the shaft 52.

Outboard of the left front pull wheel 54 is a cutting element 66. In a like manner outboard of the right front pull wheel 56 is a cutting element 68. These are identical in construction with the cutting element 68 shown in detail in FIGS. 2 and 3.

Figure 2:
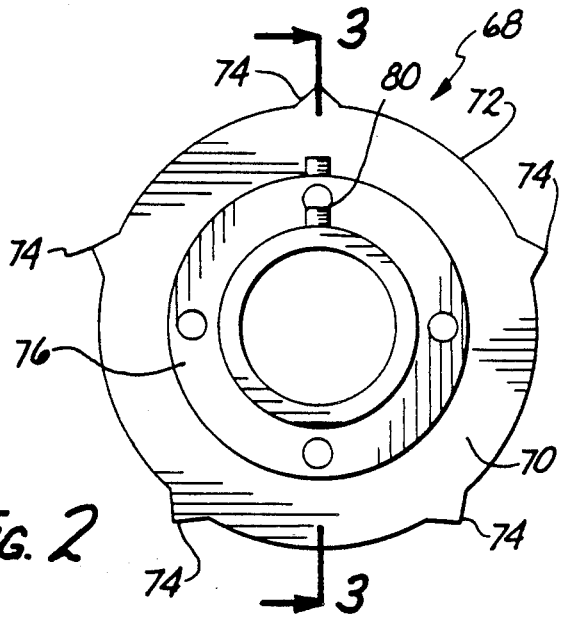
FIG. 2 is an end elevational view of a cutting element of a pouch perforator of the invention.
Figure 3:
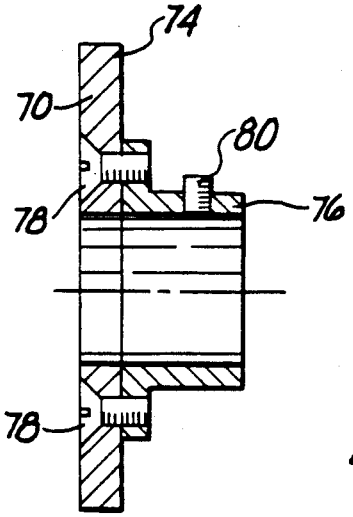
FIG. 3 is a side elevational view about the line 3—3 of FIG. 2.

As can be seen in FIGS. 2 and 3 the cutting element 68 includes a cylindrical disk 70 having a cylindrical surface 72 thereon. Spaced in an array at 72° from one another around the periphery of the cylindrical surface 72 are a plurality of knife edges collectively identified by the numeral 74. The knife edges 74 are axially positioned on the surface 72 and spaced in a circumferential array thereon.

A hub 76 attaches to the cylindrical disk 70 via counter sunk bolts collectively identified by the numeral 78. A set screw 80 in the hub 76 is utilized to fix the hub 76 and the cylindrical disk 70 to the front pull wheel shaft 50.

In a typical form, fill and seal pouch packaging machine which utilizes three inch diameter pull wheels, as for instance pull wheel 56, the diameter of the circular disk 70 across the cylindrical surface 72 would be about 2.750 inches with the diameter of the disk about the apex of the knife edges 74 being 3 inches. The knife edge apex diameter is thus equal to the diameter of the pull wheel 56.

Normally the cylindrical disk 70 including the knife edges 74 thereon, would be formed of a very hard metal, as for instance 440C stainless steel heat treated to a hardness specification of 50–54 Shore hardness.

As seen in FIG. 4 located outboard of the right rear pull wheel 60 is a support disk 82. It is attached to a hub 84 in the same manner as was described for the attachment of the disk 70 to the hub 76 in FIG. 2 and 3. The hub 84 in turn attaches via a set screw 86 to the shaft 52.

The support disk 82 includes a support surface 88 located thereon. Because of the cylindrical shape of the support disk 82, the support surface 88 is cylindrical. The support disk abuts directly against the pull wheel 60. The diameter of the support disk 82 is preferably chosen to be slightly smaller than the diameter of the pull wheel 60. Thus, if the pull wheel 60 were three inches in diameter to match the pull wheel 56, the diameter of the disk 82 would be chosen to be about 2.95 inches.

The disk 82 is preferably formed of a soft metallic material, as for instance brass or bronze. This, of course, is contrasted to the hard material, i.e. the stainless steel material, utilized to form the cylinder 70 and its knife edges 74 thereon.

The difference in the diameters of the cutting element 68 (as measured about its knife edges 74) and the support disk 82 is selected such that this difference will be about equal to the thickness of the two films 40 and 42 combined. For example the films 40 and 42 being utilized for the pouch 48 being formed in the FIG. 4, have been selected to have a combined total thickness of about 0.05 inches. If 3.0 inch pull wheels are utilized and if the diameter of the cutting element 68 as measured about its knife edges 74 is also 3.0 inches, the diameter of the support disk 82 is thus chosen to be 2.95 inches.

It is evident from the above paragraph that the radius of the cutting element 66 as measured from its center to the apex of one of its knife edges 74 is greater than the radius of the support disk 82 measured from its center to its support surface 88.

The hub 76 is used to fix the cutting element 66 to the shaft 50 and the hub 84 is utilized to fix the support disk 82 to the shaft 52. Thus, the cutting element 66 and the support disk 82 rotate in response to rotation of the respective shafts 50 and 52 on which they are mounted.

A support disk 90 identical to the support disk 82 is mounted adjacent to the left rear pull wheel 88 and interacts with the cutting element 66 in a manner as the support disk 82 interacts with the cutting element 68. The bushings 62 and 64 are chosen to be of a width such that the cutting elements 66 and 68 and their support disks 82 and 88 are positioned along the left edge 92 and the right edge 94 respectively of the bag 48 being formed from the films 40 and 42. The pull wheels 54, 56, 58 and 60 are positioned just inboard of the elements 66, 68, 88 and 82 and contact the seam areas 44 and 46 between the films 40 and 42 for advancement of the films. As the films 40 and 42 are advanced by rotation of the pull wheels 54, 56, 58 and 60, the cutting elements 66 and 68 rotate against the edges 92 and 94 of the partially formed pouch 48.

As the cutting elements 66 and 68 rotate against the edges 92 and 94 of the films 40 and 42 the films are engaged by the knife edges 74 on these cutting elements and compressed against the support surfaces, as for instance surface 88 of the support disk 82. During compression of the seam areas 44 and 46 of the films 40 and 42, between the knife edges 74 and the support surfaces, as for instance support surface 88, the knife edges 74 perforate the seams leaving notches collectively identified by the numeral 96 immediately along the edges 92 and 94 of the films 40 and 42. The notches 96 assist in tearing the heavy weight film which is utilized to form large bags on the machine 10.

Because the support disk 82 and its like support disk 90 are formed of a soft material, as for instance brass, and the cutting elements 66 and 68 are formed of hard material, as for instance hardened stainless steel, there is no appreciable wear to the knife edges 74 even when use over long periods of time. Any wear of the perforator device of the invention is on the softer support wheels 82 and 90. Since the support wheels 82 and 90 are only simple disks, they are easily and economical manufactured compared to the more complex cutting elements 66 and 68 and as such could be economically replaced should wear to them occur.

Figure 5:
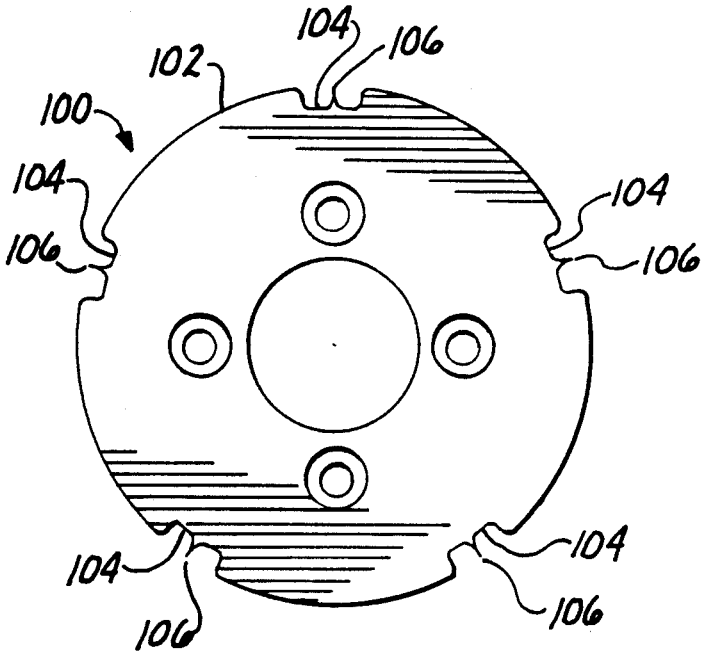
FIG. 5 is a front elevational view of a further cutting element of the invention.

FIG. 5 shows an alternate embodiment to the cutting elements 66 and 68. Shown in FIG. 5 is a cutting element 98. The cutting element 98 is formed of a circular body 100 having a cylindrical surface 102. Depressed inward in to the cylindrical surface 102 are notches, collectively identified by the numeral 104. Located in the center of each of the notches 104 is a knife edge collectively identified by the numeral 106.

The cutting element 98 would be mounted as per the cutting elements 68 noted above. In use the cutting element 98 would operate as per cutting element 66 except the surface 102 in conjunction with the support surface on an opposing support element would serve to act as a further pull wheel at such times when the knife edges 106 were not actually perforating film.

The knife edges, be they knife edges 76 or knife edges 106 are located on the respective cutting elements in association with their cylindrical surfaces and extend radially outward from the cutting elements. For the cutting elements 66 and 68 the knife edges extend radially outwardly and project above the cylindrical surface 72 of the cutting element.

Taken together the cutting elements, whether they be cutting elements 66, 68 or 98, and the support disks, i.e. support elements 82 and 90, form a perforations means for perforating the edges of pouches formed on form, fill and seal pouch packaging machines. The cutting elements including their cylindrical surface 72 and their knife edges 74 form cutting means for perforating films. The support disks 72 and 90 including the support surface 88 (and the like surface on disk 90) form supporting means which retard film from moving away from the cutting means.

As was noted the support disks 72 and 90 including the support surface 88 (and the like surface on disk 90) are preferably formed of a metal as for instance brass. Other suitable materials for the support disks, e.g. disks 72 and 90, might include hard rubber, hard plastic or the like.

The individual knife edges 74 of the cutting elements 66 and 68 can be aligned such that a knife edge on both elements 66 and 68 is at the 0° position at the same time. Alternately they can be staggered such that when a knife edge on element 66 is at 0°, the next at 72°, etc., the knife edges on element 68 are at 36°, 108°, etc. When the elements 66 and 68 are aligned, the notches on the opposite pouch sides 92 and 94 are vertically aligned otherwise they are vertically staggered in a step wise fashion on the pouch sides 92 and 94.

I claim:

1. In combination with a form, fill and seal pouch packaging machine of the type that forms pouches from continuous film and that includes at least one set of side seals, a cross seal and at least one set of pull wheels located between said side seals and said cross seal and wherein said pull wheels are for engaging and advancing said continuous film on said packaging machine, an improvement comprising:

a rotatable front pull wheel shaft located on the front side of a film pathway on said packaging machine;

a rotatable back pull wheel shaft located on the back side of said film pathway, said back pull wheel shaft located on said packaging machine in associated with said front pull wheel shaft;

said set of pull wheels including a front pull wheel and a back pull wheel;

said front pull wheel located on said front pull wheel shaft to rotate with said front pull wheel shaft;

said back pull wheel located on said back pull wheel shaft to rotate with said back pull wheel shaft, together said front and said back pull wheels engaging said film and advancing said film on said packaging machine;

a cutting element and a support element for perforating at least one edge of said pouches formed on said packaging machine, said cutting element located on said front pull wheel shaft adjacent said front pull wheel so as to be rotated by said front pull wheel shaft and said support element located on said back pull wheel shaft adjacent said back pull wheel so as to be rotated by said back pull wheel shaft;

said cutting element having a plurality of axially extending knife edges located in a circumferentially spaced array on said cutting element, said knife edges rotating in response to rotation of said cutting element;

said support element having a circumferentially extending support surface, said support surface rotating in response to rotation of said support element; and said knife edges in response to rotation of said cutting element compressing said film against said support surface top perforate said film.

2. A pouch perforator of claim 1 wherein:

said support surface is of a first hardness; and at least said knife edges on said cylindrical cutting element are of a second hardness wherein said second hardness is greater than said first hardness.

3. A pouch perforator of claim 1 wherein:

said support surface is formed of an essentially soft metal; and said cylindrical cutting element including said knife edges thereon is formed of an essentially hardened unyielding metal.

4. A pouch perforator of claim 1 wherein:

said cutting element is cylindrical in shape and includes a cylindrical cutting surface; and said knife edges are located on said cutting element in association with said cylindrical surface and extend radially outwardly from said cutting element.

5. A pouch perforator of claim 4 wherein:

said knife edges are located on said cylindrical surface and extend radially outwardly from said cylindrical surface so as to project above said cylindrical surface.

6. A pouch perforator of claim 4 wherein:

said support element is cylindrical in shape; and said support surface is a cylindrical surface.

7. In combination with a form, fill and seal pouch packaging machine of the type that forms pouches from continuous film and that includes at least one set of side seals, a cross seal and at least one set of pull wheels located between said side seals and said cross seal and wherein said pull wheels are for engaging and advancing said continuous film on said packaging machine, an improvement comprising:

a cutting element;

a support element;

said cutting element rotatively mounted on said packaging machine along the film pathway of a side edge of a pouch being formed on said packaging machine;

said support element rotatively mounted on said packaging machine in operative associated with said cutting element adjacent said pouch side edge and with said cutting element located on one side of said film and said support element located on the opposite side of said film;

said cutting element having a plurality of axially extending knife edges located in a circumferentially spaced array on said cutting element, said knife edges rotating in response to rotation of said cutting element;

said support element having a circumferentially extending support surface, said support surface rotating in response to rotation of said support element; and said knife edges in response to rotation of said cutting element compressing said film against said support surface to perforate said film.

8. A pouch perforator of claim 7 wherein:

said cutting element is cylindrical in shape and includes a cylindrical surface; and said knife edges are located on said cutting element in association with said cylindrical surface and extend radially outwardly from said cutting element.

9. A pouch perforator of claim 8 wherein:

said knife edges are located on said cylindrical surface and extend radially outwardly from said cylindrical surface so as to project above said cylindrical surface.

10. A pouch perforator of claim 7 wherein:

the radius of said cutting element measured from the center point of said cutting element to the apex of one of said knife edges is of a first radius;

said support element support surface is cylindrical in shape, the radius of said support element measured from the center point of said support element to said support surface being of a second radius; and the measure of said second radius being less than the measure of said first radius.

11. A pouch perforator of claim 7 wherein:

at least said support surface of said support element is formed of an essentially soft metal; and said cutting element including said knife edges thereon is formed of an essentially hardened unyielding metal.

12. In combination with a form, fill and seal pouch packaging machine of the type that forms pouches from continuous film and that includes at least one set of side seals, a cross seal and at least one set of pull wheels located between said side seals and said cross seal and wherein said pull wheels are for engaging and advancing said continuous film on said packaging machine, an improvement comprising:

a rotatable first pull wheel shaft located on one side of a film pathway on said packaging machine;

a rotatable second pull wheel shaft located on the other side of said film pathway, said second pull wheel shaft located on said packaging machine in associated with said first pull wheel shaft;

said set of pull wheels including a first pull wheel and a second pull wheel;

said first pull wheel located on said first pull wheel shaft to rotate with said first pull wheel shaft;

said second pull wheel located on said second pull wheel shaft to rotate with said second pull wheel shaft, together said first and said second pull wheels engaging opposite sides of said film gripping said film between said first and second pull wheels and advancing said film on said packaging machine;

a cutting element, said cutting element located on said first pull wheel shaft adjacent to but independent of said first pull wheel so as to rotate by said first pull wheel shaft in concert with said first pull wheel;

a support element, said support element located on said second pull wheel shaft adjacent to but independent of said second pull wheel so as to rotated by said second pull wheel shaft in concert with said second pull wheel; and together said cutting element said support element for perforating at least one edge of said pouches formed on said packaging machine.

13. The combination of claim 12 further including:

said cutting element having a plurality of axially extending knife edges located in a circumferentially spaced array on said cutting element, said knife edges rotating in response to rotation of said cutting element;

said support element having a circumferentially extending support surface, said support surface rotating in response to rotation of said support element; and said knife edges in response to rotation of said cutting element compressing said film against said support surface to perforate said film.

* * * * *